United States Patent [19]

Thekdi et al.

[11] 4,272,239

[45] Jun. 9, 1981

[54] DIRECT HEATING OF HEAT TREAT FURNACE CHAMBER

[75] Inventors: Arvind C. Thekdi, Sylvania; Richard R. Mayers, Delta, both of Ohio

[73] Assignee: Midland-Ross Corporation, Cleveland, Ohio

[21] Appl. No.: 90,888

[22] Filed: Nov. 5, 1979

[51] Int. Cl.[3] ..... F27D 7/00; F27B 9/04; F27B 5/04

[52] U.S. Cl. ..... 432/19; 432/23; 432/72; 432/198

[58] Field of Search ..... 432/19, 23, 72, 198

[56] References Cited

U.S. PATENT DOCUMENTS

| | | | |
|---|---|---|---|
| 2,124,764 | 7/1938 | Comstock | 432/23 |
| 2,763,476 | 9/1956 | Ness et al. | 432/72 |
| 2,799,490 | 7/1957 | Rusciano | 432/72 |
| 3,345,846 | 10/1967 | Hess | 432/23 |
| 3,804,580 | 4/1974 | Golding | 432/23 |

FOREIGN PATENT DOCUMENTS

| | | | |
|---|---|---|---|
| 318552 | 7/1930 | United Kingdom | 432/19 |

*Primary Examiner*—John J. Camby
*Attorney, Agent, or Firm*—Richard A. Negin

[57] ABSTRACT

The present invention is an improved apparatus and method for directly heat treating articles in a sealed treatment chamber of the heat treatment furnace. A burner means fires into a precombustion chamber which is connected in communication with the treatment chamber. Combustion is completed in the precombustion chamber and the products of combustion are fed into the treatment chamber. Additional treatment gas such as an endothermic gas is fed directly into the furnace treatment chamber.

16 Claims, 8 Drawing Figures

DIRECT HEATING OF HEAT TREAT FURNACE CHAMBER

BACKGROUND OF THE INVENTION

This invention relates to a method and apparatus for directly heat treating articles in a treatment chamber of a heat treatment furnace.

It is known in the art to directly heat treat metal articles in the treatment chamber of a heat treatment furnace. The term "to directly treat heat" refers to direct transfer of heat from the heat source to the articles to be heat treated in a controlled furnace atmosphere, i.e. direct transfer of heat from the products of combustion from a burner to the articles to be treated in a controlled atmosphere.

U.S. Pat. No. 2,763,476, Two Stage Combustion Furnace, by H. J. Ness et al, describes a furnace in which the products of combustion from burners positioned to fire directly into the furnace chamber are used to treat articles within the chamber. This patent describes an apparatus and method for directly heating work to high temperatures in the products of combustion of the heating fuel without scaling. Fuel and air are reacted in the heating chamber of the furnace in such a manner as to obtain a predetermined ratio of the constituents of the gaseous reaction products which is protective in nature to the work to be heated and at the same time maintaining a high temperature and heating rate in the furnace. A carbon dioxide to carbon monoxide ratio is obtained which is below the oxidizing ratio of these gases at the operating temperature in the furnace. The reaction products, in the Ness furnace, will have a high hydrogen and incompletely consumed carbon and hydrocarbon content.

In the Ness patent the roof of the furnace chamber has a plurality of spaced arched sections forming narrow channels. The sidewall of the furnace chambers has a series of burners in a position to fire into the channels and against the face of the arch. After-burned exhaust gases from the furnace chamber serve to heat the arched roof. The heating of the arched roof with the exhaust gases serves as an additional heat input into the work chamber. The arches and walls between the plurality of arches are heated to a temperature above the reaction temperature of the mixture supplied to the burners. This feature is important in this invention since it facilitates the reaction in the work chamber and permits air/fuel mixtures to be employed which include the endothermic range. These reactions are further facilitated by the channeled arrangement of the arch members whereby severe scrubbing of the entering furnace mixture occurs on the hot surfaces of the arch and walls between the arches. The catalytic effect of the hot brick work resulting from the scrubbing referred to above promotes the completion of these reaction,s whether they be endothermic or exothermic.

The Ness patent further discloses that in some cases it may be preferable to supply a air/fuel mixture to the burners which will produce a carbon monoxide content somewhat lower than what is desired at the work, and to increase this content by the subsequent addition of raw gas to the furnace at a point where the primary reactions have been completed. For this purpose the furnace is provided with a number of gas addition tubes entering the heating chamber below the arch. The tubes can be supplied with any suitable raw gas or rich endothermic mixture of fuel and air. The gas admitted by the tubes will be cracked endothermically to liberate carbon and hydrogen for contact with the work. These elements by virtue of their strong reducing tendency serve to reduce or prevent the formation of scale on the work, or, if desired, may be supplied in sufficient quantity to produce carburization of the work surface.

In order to prevent premature cracking of these raw gas additions and the consequent deposition of soot in the tubes, they are preferably provided with a cooling jacket through which cooling air may be circulated.

In bringing the Ness furnace up to heat, the air to fuel mixture is preferably readily combustible with a high flame temperature, as for instance, with natural gas, an air to fuel ratio of about 10 to 1. After the desired furnace temperature has been attained and before the work is placed in the work chamber, the air to fuel ratio is reduced either to the desired rich exothermic or endothermic range necessary to produce the carbon dioxide to carbon monoxide ratio in the work chamber required for the protection of the work. The burners are specially designed to preheat the gases within the burner.

U.S. Pat. No. 2,799,490, Two Stage Combustion Furnace, by Rusciano, copended with the Ness patent. Rusciano notes that, in order to produce the work protective atmosphere from the rich air/fuel mixture, it is necessary to supply external heat to the constituents to increase the reaction temperature. The normal temperature of these reactions are not sufficient to drive them to completion with the results that some solid would be formed. If the additional heat is not supplied the air to fuel ratio of the mixture must be increased and consequently the $CO_2/CO$ and $H_2O/H_2$ ratios will be increased to a point where they no longer represent non-scaling conditions in the furnace. If efforts are made to overcome this difficulty by increasing the fuel content of the mixture, lower reaction temperatures with increased soot formation is obtained.

In the Rusciano patent the furnace has a work heating chamber supplied with the plurality of burners to which a rich mixture of fuel and air is supplied for combustion directly in the work heating chamber. In order that the products of this combustion shall be non-scaling character it is necessary that the ratio of the fuel to air be such as to produce, upon completion of the thermal reactions, resulting products in which the sum of the $CO_2/CO$ and $H_2O/H_2$ ratio is equal to 1.0. With gaseous fuels this unity ratio summation is obtained with approximately 52% of the air that would be required for complete combustion of the fuel. With oil fuels the ratio may be increased up to about 58% depending upon the $C/H_2$ ratio of the fuel.

The primary combustion of the air and the fuel is effected between radiant tubes and a wall of the furnace in a portion of the chamber away from the work whereby the reaction products receive radiant heat both from the tubes and the hot walls of the furnace and by conduction in passing in contact with such walls and tubes in transit to the work. The primary air/fuel mixture which has a deficiency of air, in the order of 50%, is supplied to the work chambers by a series of burners disposed in the sidewalls of the furnace directly above the radiant tubes. The arched roof of the furnace chamber together with the radiant tube surfaces act as high temperature catalysts to promote the primary reactions as the gases are scrubbed thereover. Burners are set in opposite walls enhancing the agitation the gases receive in contacting these areas. Additionally, the furnace chamber may be provided with a number of built up thin refractory arch sections extending between radiant tubes which are parallel to the roof of the heating chamber. These sections absorb heat from the tubes and serve as additional hot refractory for contact with the reacting products. They also serve to channel a reaction product more intimately into contact with the tubes and thereby enhance the absorption of heat from the tubes during the passage of the gaseous products to the work. In addition, the arches act as radiant surfaces for heating of the work thus assisting in maintaining a more uniform heat distribution of the work.

It is desireable to directly heat treat articles in a sealed furnace treatment chamber without the necessity of having a cumbersome chamber geometry and supplemental heat supply necessary in the prior art.

SUMMARY OF THE INVENTION

The present invention is an improved apparatus and method for directly heat treating articles in a sealed treatment chamber of the heat treatment furnace. A burner means fires into a precombustion chamber which is connected in communication with the treatment chamber. Combustion is completed in the precombustion chamber and the products of combustion are fed into the treatment chamber. Additional treatment gas such as an endothermic gas is fed directly into the furnace treatment chamber.

It is the general object of the present invention to provide a method and apparatus for directly heat treating articles in the sealed treatment chamber of a heat treatment furnace. More particularly, it is an object of the present invention to directly heat treat articles in a sealed treatment chamber without cumbersome structural modifications of the furnace chamber. It is another object of the present invention to reduce the size of furnaces necessary for the heat treatment of articles by direct heating of articles in a sealed treatment chamber. It is further an object of the present invention to provide a method of directly heating articles in the treatment chambers of a heat treatment furnace without scaling or sooting. It is another object of the present invention to carburize articles in a furnace chamber in an atmosphere which comprises a carburizing gas and the reaction products from a burner.

It is the object of this invention to obtain one or more of the objects set forth above. These and other objects and advantages of this invention will become apparent to those skilled in the art from the following specification and claims, reference being had to the attached drawings.

DESCRIPTION OF THE PREFERRED EMBODIMENTS

Figure 1:
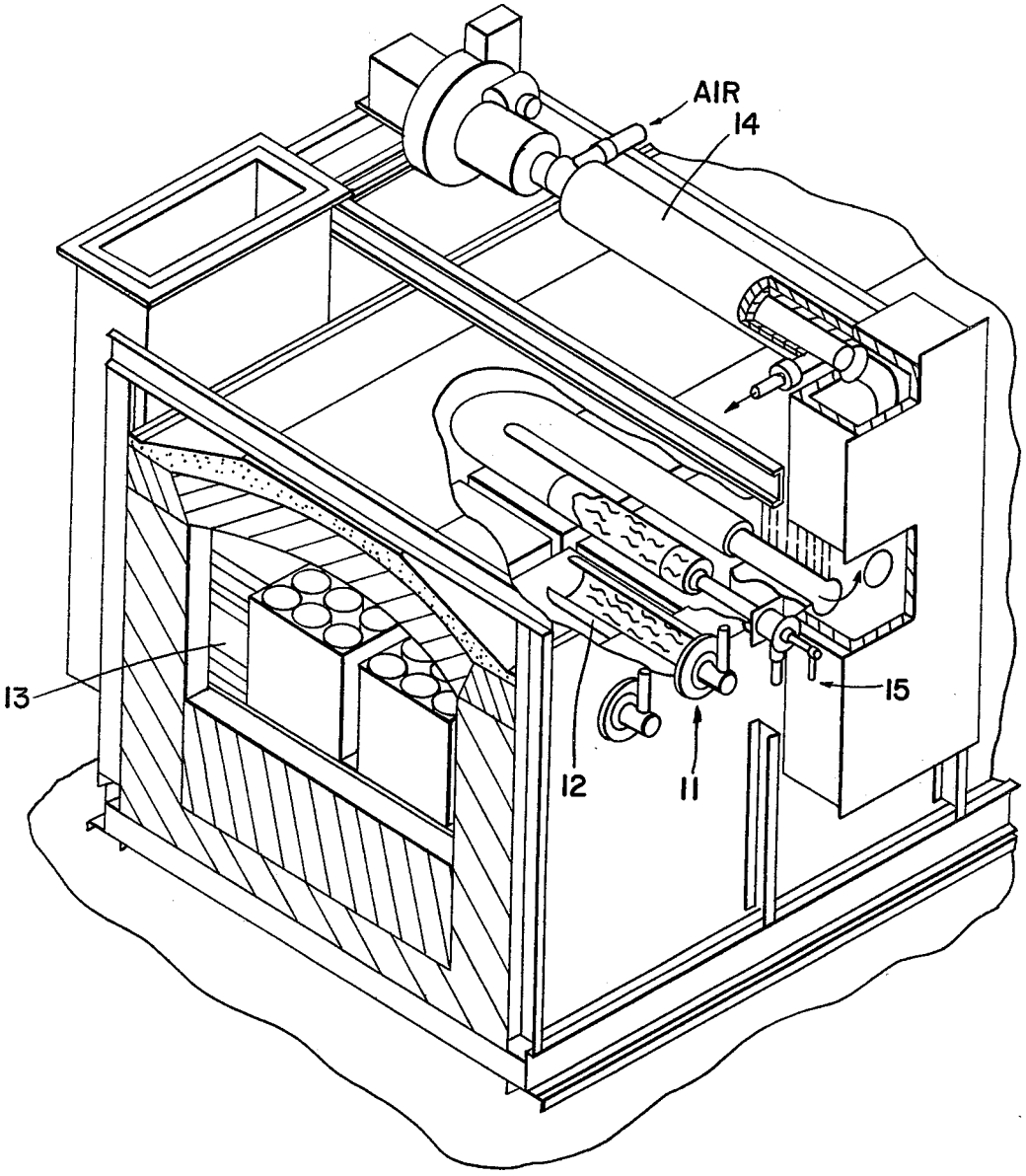
FIG. 1 shows a perspective view of a treatment furnace embodying the present invention.
Figure 2:
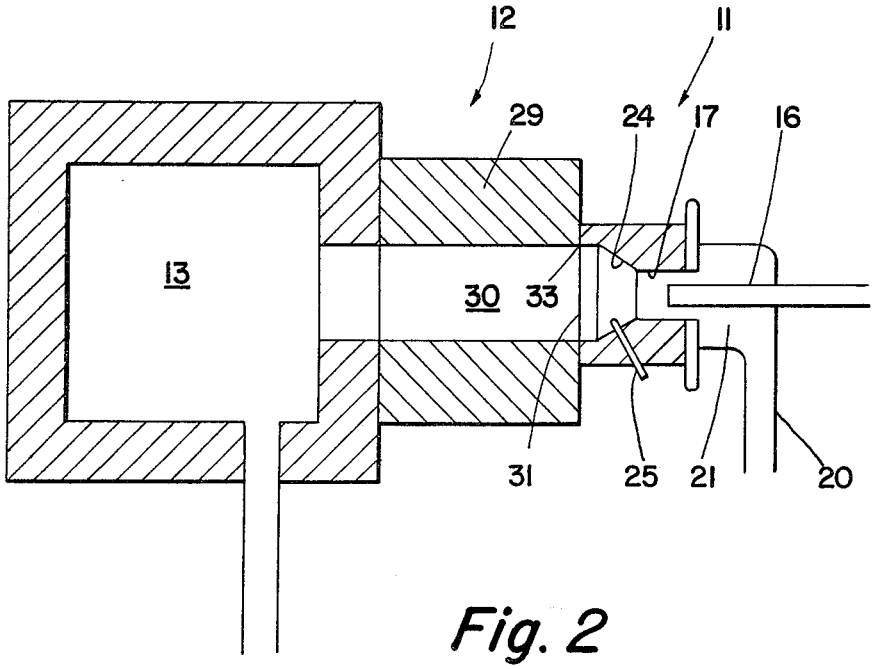
FIG. 2 is a schematic view of the present invention.

The present invention will be understood by those skilled in the art by reference to FIGS. 1 and 2. FIG. 1 is a view in perspective of the invention in place in a heat treatment furnace and FIG. 2 is a schematic showing the various parts of the invention. The present invention as shown in FIG. 1 is shown with a continuous carburizing furnace. Continuous carburizing furnaces generally contain a heating zone, at least one carburizing zone and a cooling zone. Although the direct heat treating system of the present invention can be used in both heating and carburizing zones, it is preferably used in the heating zone where the articles to be treated are heated up to treatment temperature. As shown in FIG. 1, there is a burner means 11, a precombustion chamber 12 and a furnace treatment chamber 13. There can also be a means to preheat air such as recuperator 14. The direct heat treating system of the present invention can be used as the sole source of heat or can be augumented by other heating means. It is preferable to have additional heating means such as radiant tube 15 as shown in FIG. 1 which can use the exhaust from treatment chamber 13 atmosphere as fuel.

Because it is an object of this invention to complete combustion of the controlled amounts of fuel and air before the products of combustion leave a means to complete combustion such as precombustion chamber 12, it is preferred to use a throat mix type burner 11 although other burner means known in the art can be used. Referring to the schematic drawing of FIG. 2, throat mix burner 11 is shown as having a fuel inlet means such as pipe 16 leading to throat 17. An air inlet means comprises air inlet 20 connected to air inlet chamber 21. Air inlet chamber 21 surrounds fuel inlet pipe 16. Air is fed from air inlet 20 through the air inlet chamber 21 into throat 17 where it mixes with fuel fed into throat 17 from fuel inlet pipe 16. The air and fuel mixture passes from throat 17 into burner ignition chamber 24 where an ignition means such as spark plug 25 causes ignition. The ignited mixture passes through the burner mouth 31 to precombustion chamber 12. For a typical heating zone used in a commercial furnace a TMG 500 burner, i.e. 500,000 Btu per hour throat mix burner, can be used.

Figure 3:
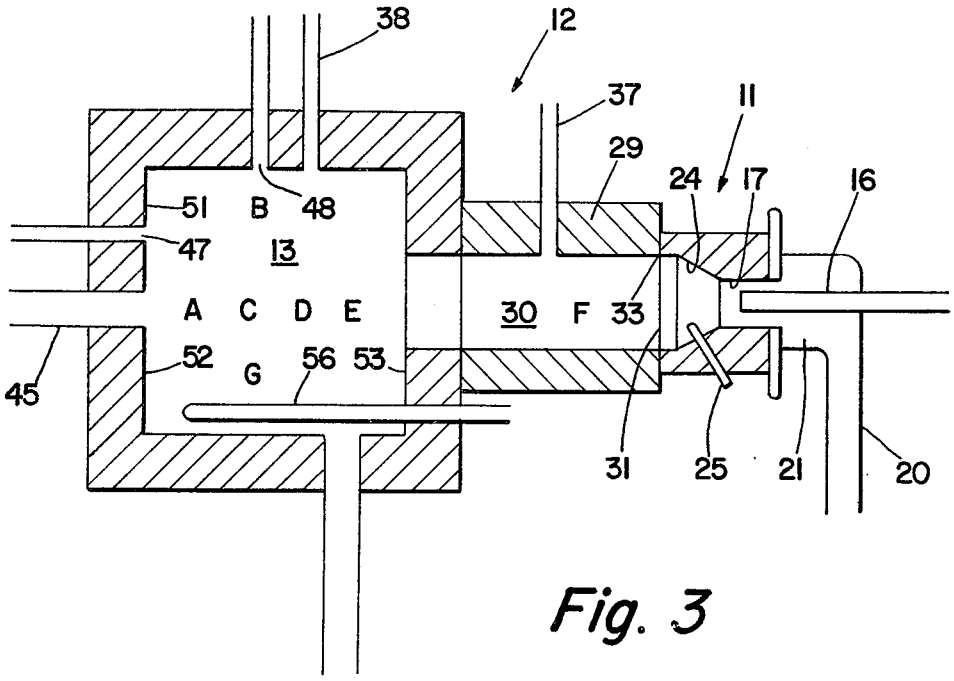
FIG. 3 is a schematic view of the experimental set up of the treatment chamber and precombustion of the present invention.

Experimental work in developing the direct fired system of the present invention was conducted in treatment chamber 13 as shown in FIGS. 2 and 3. The work was directed to the development of direct heat treating of metal articles in a carburizing furnace. In carburizing heat treatment the article is heated in a controlled atmosphere. Atmospheres commonly used are described in the *Metals Handbook,* 8th Edition, Vol. 2, Heat Treating, Cleaning and Finishing, prepared under the direction of the American Society for Metals Handbook Committee (1969), Furnace Atmospheres and Carbon Control starting at page 67. Commonly used carburizing atmospheres are endothermic atmospheres such as Class 302 rich endothermic atmosphere having a composition in volume percent of: 39.8% $N_2$, 20.7% CO, 38.7% $H_2$ and 0.8% $CH_4$. Nominally Class 302 atmosphere can be considered to be 20% CO, 40% $H_2$, 40% $N_2$ and a trace of $CH_4$. This type of atmosphere has been used in the development of the present invention although it is obvious to use direct heat treating of the present invention with other treatment atmosphere compositions.

Experimental work using direct fired heating of articles to be carburized by firing a burner directly into an experimental treatment chamber did not result in the proper atmosphere for obtaining scale-free samples. Scale is the oxidation of the surface of the metal article to be treated. The presence of too great of a concentration of water vapor compared to hydrogen can cause scale. Further, it has been found that even with endothermic gas added to the products of combustion in the treatment chamber, satisfactory results in terms of obtaining a scale-free carburizing atmosphere were not obtained with different air to fuel ratios. It is speculated that there is a chemical mixture of the circulating endothermic gas, air and fuel which is preferably natural gas (hereinafter "gas"). To avoid this, the gas and air reaction must be brought to completion before mixing with the endothermic gas so that the products of combustion have only a physical mixing with the endothermic gas rather than a chemical combination of air and endothermic gas interferring with the gas and air combustion reaction. To accomplish this, it has been found that it is necessary to have means such as a precombustion chamber 12 to bring the natural gas and air reaction to completion prior to adding endothermic gas.

FIG. 2 schematically shows precombustion chamber 12. The only critical limit on the precombustion chamber is that it must be large enough so that the combustion of air and gas reach completion with the precombustion chamber 12 before entering the treatment chamber 13. A preferred precombustion chamber has appropriate insulation 29 and is designed to have a minimum pressure drop so that the products of combustion move unimpeded from the burner through the precombustion chamber 12 and into the treatment chamber 13. Preferably, the chamber portion 30 of the precombustion chamber has a cross section which corresponds to the shape of the mouth 31 of burner 11. Generally, the mouth of the burner is circular so that the chamber portion 30 of precombustion chamber 12 will be cylindrical having a diameter about equal to the diameter of the mouth of the burner 31. A precombustion chamber inlet 33 is connected to the mouth of the burner 31 and a chamber outlet 34 is connected to treatment chamber 13 and positioned to feed combustion gases from the precombustion chamber 12 into the treatment chamber 13. The length of the chamber portion 30 of the precombustion chamber must be long enough so that combustion of the fuel air mixture is brought to completion before being fed into treatment chamber 13. The combination of burner 11 and precombustion chamber 12 can be built onto new furnaces or easily retrofit onto existing furnaces.

Preferably, treatment gas, such as an endothermic carburizing gas, is added directly to the treatment chamber 13 and not into precombustion chamber 12. This is because when endothermic gas was added to the precombustion zone at low air to gas ratios, there was a significant increase in methane content in the facility. When the endothermic gas was added to the treatment chamber 13 with the burner operating at low air to gas ratios, there was very little or no increase in methane during experimental tests on a prototype as discussed below. The natural gas and air reaction is brought to completion in the precombustion chamber before mixing with the endothermic gas. The burner 11 was turned back, the amount of air reduced, almost to the point of going out without getting excess methane in the facility when the endothermic gas was added to the treatment chamber 13. An excess of methane can result in sooting and is therefore, undesirable.

In the preferred embodiment of this invention, the combustion air is preheated, by a suitable means to preheat, before entering the burner means 11. Although it is not necessary to preheat the air, it is found that the greater the temperature of the air the greater the flame stability at low air to gas ratios. Tests were conducted using an experimental step up which are described with reference to FIGS. 2 and 3. In the tests a TMG-125 burner, i.e. a throat mix, 125,000 Btu per hour, burner was used for heating. Tests were directed toward carburizing articles in the treatment chamber 13. The articles were directly heated by the products of the combustion from the burner means 11. To carburize articles it is necessary to use an inert or protective atmosphere containing a controlled carbon potential. The air deficient, fuel and air combination, reacts to form water, carbon monoxide, hydrogen and carbon dioxide. In the present invention it is desirable to run the burner as rich as possible without burner flame instability. The optimum air to gas ratio for complete combustion of the fuel is about 10 parts air to 1 part of gas by volume.

Using the experimental facility, containing a treatment chamber 13, a precombustion chamber 12 and a burner means 11, process conditions were determined at temperatures of 1600° F., 1700° F. and 1800° F. The experiments conducted to develop the present invention was conducted using a rich endothermic gas having a composition of about 20% hydrogen, 40% carbon monoxide and 40% nitrogen. Of course, the apparatus of the present invention can be used with other treatment gases. Thirty to forty volume percent endothermic carburizing gas, considering air, gas and carburizing gas, was added to obtain the proper atmosphere for heating zone carburizing. In the heating zone the articles are heated to the temperature at which they are to be carburized.

The carburizing atmosphere can be defined in terms of the ratios of the $H_2O$ to $H_2$ and $CO_2$ to CO with the amount of carbon going into the articles to be carburized depending upon the amount of CO to $CO_2$ while the scale formation being related to the amount of $H_2O$ to $H_2$. Although about 30 to 40 percent by volume of an endothermic gas was generally found to be necessary, the quantity of endothermic gas required is related to the air to gas ratio which can be maintained at the burner. Less endothermic gas is necessary to be added to the treatment chamber at lower air to gas ratios attained at the burner. In the present invention, throat mix burners were used since these type of burners satisfactorily attained the necessary air to gas ratio.

The test facility was designed so that treatment gas could be either added to the precombustion chamber 12 or to the main treatment chamber 13. Tests were conducted with endothermic gas for use to carburize articles added to either chamber. FIG. 3 shows a schematic diagram of the test chamber with a feed port 37 to precombustion chamber and a feed port 38 to the treatment chamber through which treatment gas such as endothermic gas can be fed.

As stated above, it has been found if endothermic gas is added in the presence of air, the methane content in the treatment chamber 13 will rise and result in sooting. When endothermic gas was added through the feed port 37 to the precombustion chamber an increase in methane content was found. When endothermic gas was added to the feed port 38 of the treatment chamber and combustion completed at a controlled air to gas ratio to the burner 11, there was either no increase in methane or the increase was very small. The precombustion chamber 12 therefore brings the natural gas and air reaction to completion before mixing with endothermic gas. The burner was turned back to nearly the point of going out without getting excess methane in the treatment chamber 13 when the endothermic gas was added to the treatment chamber. The test facility shown in FIG. 3 had a means 45 to insert carbon steel samples to be treated. Gas samples were taken from the treatment chamber 13 with water cooled probes. Probes can be inserted through water probe port 47 in line with the burner and are able to move horizontally across the treatment chamber. Probe port 48 which is vertical so that a probe can be inserted through the top of treatment chamber and passed vertically down through the chamber.

Temperatures within the treatment chamber 13 were measured by thermocouple 51 in the wall opposite and in line with the precombustion chamber, thermocouple 52 in the wall opposite the precombustion chamber and below it, and thermocouple 53 in the wall through which the precombustion chamber feeds combustion gases. Water cooled probe 56 was used to control furnace temperature. In a commercial furnace any suitable means can be used to control furnace temperature. This is particularly true where an auxiliary treating means such as radiant tubes 15 shown in FIG. 1 are used. In this case the temperature can be controlled by controlling the amount of heat from the auxiliary heating means.

Gas composition was measured by a Beckman Infrared analyzer used for monitoring carbon monoxide; Lira Infra-red analyzer used to monitor carbon dioxide and methane; and Teledyne Portable Flue Gas Analyzer used to monitor the percent oxygen and the percent combustibles. In addition, Orsat and/or chromatograph readings were taken for chemical analysis. Gas flow rates were measured by orifice-type flow meters.

Tests were performed in this facility with the burner operating approximately stoichiometrically with 125 standard cubic feet per hour of gas and 1250 standard cubic feet per hour of air. When the furnace chamber was brought up to temperature either the air was turned back to the lowest air to gas ratio possible or the gas flow was increased and the air decreased. Various percentages of endothermic gas, from 0% to 40% were added and the facility was allowed to run until conditions stabilized. A gas analysis was then made by the Orsat and/or chromatograph and carbon steel sample was placed in the facility. Combustion air was preheated to 800° F. to 900° F. for use at the various air to gas ratios used at the burner 11. Trials were made with different volume percentages of endothermic gas added either in the precombustion chamber or in the treatment chamber.

When endothermic gas having a composition of approximately 20% hydrogen 40% carbon monoxide and 40% nitrogen were added to precombustion chamber 12, the methane content in the treatment chamber 13 was measured to be about 0.1 to 0.2% methane and increased to about 0.5 or 0.7% methane. When the endothermic gas was added to the main chamber, the increse in the methane content was either 0% or very small, i.e. approximately 0.1%. Upon determining that the endothermic gas be added into the treatment chamber, further testing was made with the endothermic gas only added to the main treatment chamber.

When the endothermic gas was added to the treatment chamber no sooting problems were encountered during the course of the experimental work. Initially, an air to gas ratio of 9.5 to 1 with 0% endothermic gas added resulted in 0% combustibles and 0% oxygen based on flow measurements. Therefore, flow measurements show that a 9.5 to 1 air to gas ratio resulted in perfect stoichiometric conditions. The experimental treatment chamber, shown in FIG. 3, is 2 feet wide and 2.5 feet high. The concentration of hydrogen was taken with a water cooled probe through port 47 every six inches across the width of the furnace at points A, C, and D. The hydrogen concentration was also taken at the outlet 34 of the precombustion chamber at point E and at the center of the precombustion chamber at point F. All of these measurements were taken with a water cooled probe through port 47 along the axial center of the precombustion chamber. Hydrogen concentrations were also measured at the top and bottom of the treatment chamber using a probe through port 48 to make measurements at points B and G. The measurements of volume percent hydrogen concentration when 0 to 30 volume percent endothermic gas was added are summarized in Table I below. The minimum attainable air to gas ratio based on flow measurements which could satisfactorily be used was 5.26 during this test.

TABLE I

| % Endo Gas | A | C | D | E | F | B | G |
|---|---|---|---|---|---|---|---|
| 0 | 15.05 | — | 14.1 | 13.05 | 10.85 | — | 12.9 |
| 30 | 19.38 | 18.7 | 13.9 | 14.7 | — | 17.45 | — |

Figure 4:
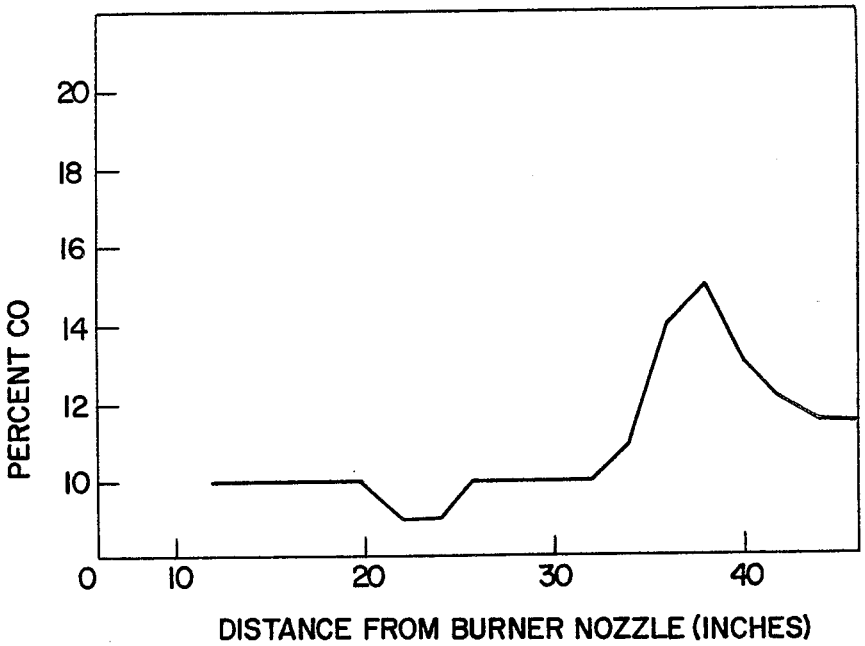
FIG. 4 is a graph of percent CO vs. distance from the burner nozzle.
Figure 5:
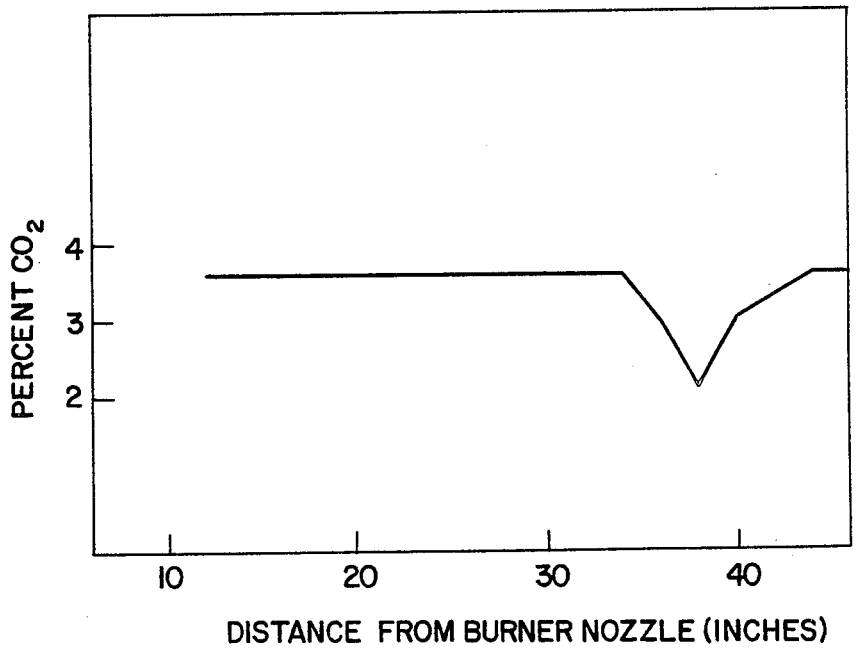
FIG. 5 is a graph of percent $CO_2$ vs. distance from the burner nozzle.

Tests were also carried out to determine the volume percent of CO and $CO_2$ at the different points along a line from the back of the test facility to the burner with water cooled probe through port 47. Measurements were taken every two inches using the Infra-red analyzers with 30% endothermic gas. Results of these measurements are shown in FIGS. 4 and 5. The low points in FIG. 4 at 22–24 inches from the burner nozzle are near the outlet 34 of the precombustion chamber 12. The peak in the curve of FIG. 4 at 38 inches from the burner nozzle is at a point directly under the feed port 38 of the treatment chamber where the endothermic gas is added. FIG. 5 shows no change in carbon dioxide concentration at the outlet 34 of the precombustion chamber but does show a decrease at the point where the endothermic gas enters.

FIGS. 4 and 5 show that non-unifomities are possible in a commercial size furnace. A suitable means to assure atmosphere uniformity may be required. This mixing means could be a suitable location of the means to feed treatment and of the precombustion chamber, controlled flow such as with jet nozzles or any other mixing means known in the art.

Tests were conducted to determine whether an acceptable atmosphere for carburizing could be obtained in a direct fired carburizing heating zone. As noted above, it was found that a suitable means such as a precombustion chamber 12 was necessary to complete combustion of the fuel before entry of the products of combustion into the treatment chamber or contact with endothermic gas. Acceptable atmosphere is defined as one in which the ratios of $CO_2$ to CO and $H_2O$ to $H_2$ are such as to cause the reduction of iron without sealing or sooting.

During this experimentation orifice flow measurements were taken and air to gas ratios determined. Table II below summarizes the data and calculations for acceptable runs. Data was taken to determine air to gas ratios based on chemical analysis in addition to air to gas ratios based on orifice flow meter measurements. Therefore, Table II shows air to gas (A/G) ratios based on flow meter measurements and based on calculations from the chemical analysis. The calculated air to gas ratios were higher than those obtained by flow measurements, i.e. in the order of 10%. There is a third type of air to gas ratio to consider which is the equivalent air to gas ratio. This is the air to gas ratio resulting from a mixture of the reaction products of the air, gas and endothermic gas.

to gas ratios in order to achieve the necessary equivalent air to gas ratio for a suitable carburizing atmosphere. The equivalent air to gas ratio is the air to gas ratio resulting from the mixture of the endothermic gas and the products of the combustion of gas and air. The graph indicates that in an air to gas ratio at the burner of 5.2 to 1, a suitable gas atmosphere could be achieved with 24% endothermic gas at 1600° F. In actual experiments where a 5.2 to 1 air to gas ratio was indicated at the burner by flow measurements, 30 to 40% endothermic gas was required. Actual flow values show a need for endothermic gas greater than predictions based on chemical measurements and calculations.

Carbon steel bar samples were placed in the furnace at 20%, 25%, 30%, 33%, 35% and 40% endothermic gas atmosphere. None of the samples showed sooting but all showed signs of oxidation except those where about 40% endothermic gas was added.

TABLE II

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| Probe Pos. | Air Flow SCFH | Fuel Flow SCFH | RX Flow SCFH | CO Dry Meas. | $CO_2$ Dry Meas. | $H_2$ Dry Meas. | Calc. $H_2O$ | Calc. Wet CO | Calc. Wet $CO_2$ | Calc. Wet $H_2$ | Burner Meter A/G | Meter Total A/G | Calc. A/G | Fce. Temp. °F. | $H_2O$ / $H_2$ |
| X | 680 | 130 | 430 | .141 | .033 | .214 | .110 | .126 | .029 | .109 | 5.247 | 4.149 | 4.575 | 1640 | .578 |
| Y | 670 | 140 | 520 | .135 | .034 | .208 | .107 | .121 | .030 | .186 | 4.796 | 3.814 | 4.540 | 1680 | .575 |
| X | 671 | 130 | 525 | .148 | .027 | .224 | .103 | .133 | .024 | .201 | 5.181 | 3.978 | 4.302 | 1630 | .510 |
| X | 670 | 130 | 525 | .147 | .031 | .222 | .109 | .131 | .028 | .198 | 5.174 | 3.974 | 4.428 | 1640 | .549 |
| Z | 591 | 130 | 310 | .142 | .032 | .215 | .109 | .127 | .029 | .191 | 4.564 | 3.894 | 4.491 | 1660 | .570 |
| Z | 640 | 125 | 520 | .150 | .030 | .224 | .110 | .133 | .027 | .200 | 5.120 | 3.928 | 4.417 | 1600 | .551 |

Referring to Table II, air flow (column 2), fuel flow (column 3), RX or endothermic gas flow (column 4) and Burner Meter A/G or air to gas (column 12) are based on orifice flow measurements. The Meter Total A/G ratio (column 13) is the equivalent air to gas ratio considering the addition of endothermic gas and is based on orifice flow measurements. The calculated A/G or air to gas ratio as shown in column 14 is based on Orsat readings. The calculated $H_2O$ of column 8 is based on the ratio of carbon to hydrogen. The data in columns 5 through 11 are volume fractions of the atmosphere. The locations of the probe used to measure gas composition is indicated in column 1. Probe position X is at the bottom of the furnace; probe position Y is six inches from the back of the furnace; and probe position Z is six inches from the bottom of the furnace.

All of the data in Table II are for 40% endothermic gas added directly to the treatment chamber except for the fifth run which is for 30% endothermic gas added. Carbon steel bar samples tested in the runs listed showed neither oxidation or sooting. In all cases where an acceptable atmosphere was achieved, the percentage of dry hydrogen was 20.8% or higher and the calculated $H_2O$ was 11% or lower.

Figure 6:
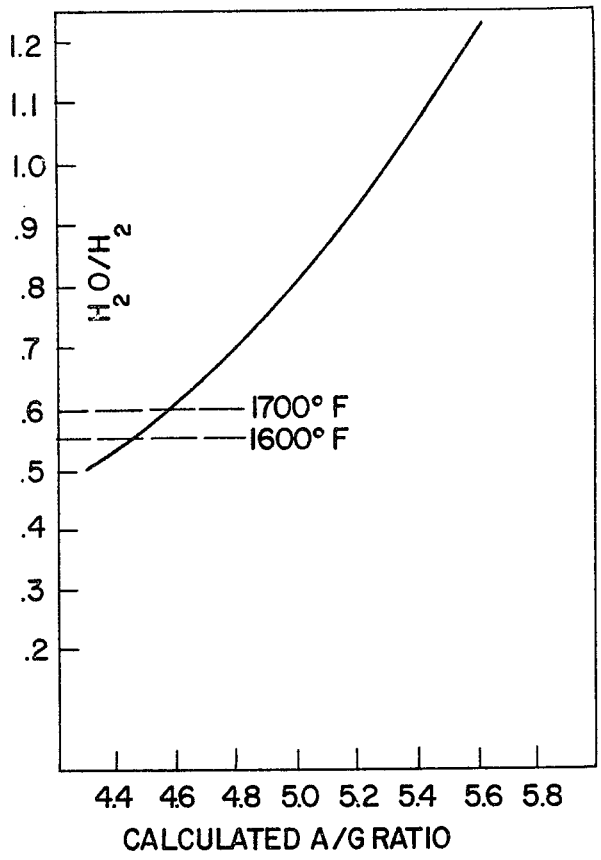
FIG. 6 is a graph of the ratio of $H_2O/H_2$ vs. calculated air to gas (A/G) ratio.
Figure 7:
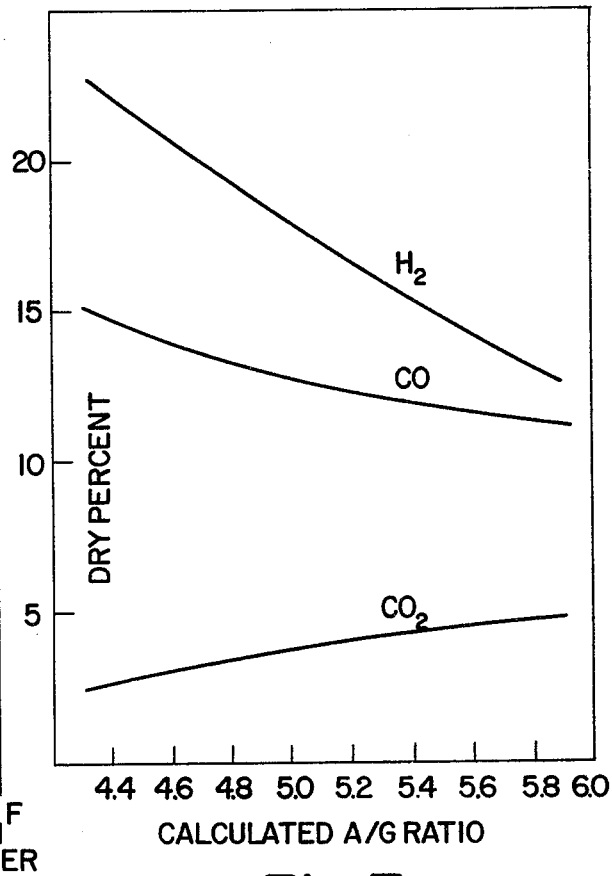
FIG. 7 is a graph of dry percent $H_2$, CO and $CO_2$ vs. calculated air to gas (A/G) ratio.

Data taken from all experimental runs is plotted in FIGS. 6 and 7. Based on FIG. 6, at 1700° F., the air to gas ratio by chemical analysis is about 4.56 or less to obtain the proper atmosphere, with the $H_2O$ to $H_2$ ratio less than about 0.6, and at 1600° F. this air to gas ratio would have to be about 4.44 or less to obtain a proper atmosphere, with the $H_2O$ to $H_2$ ratio less than about 0.55. Considering FIG. 6 and Table II, it is estimated that at 1800° F. the air to gas ratio is about 5.0 based on chemical analysis to obtain a proper atmosphere. FIG. 7 is a plot of dry percent hydrogen, carbon monoxide and carbon dioxide which resulted with various calculated air to gas ratio.

Figure 8:
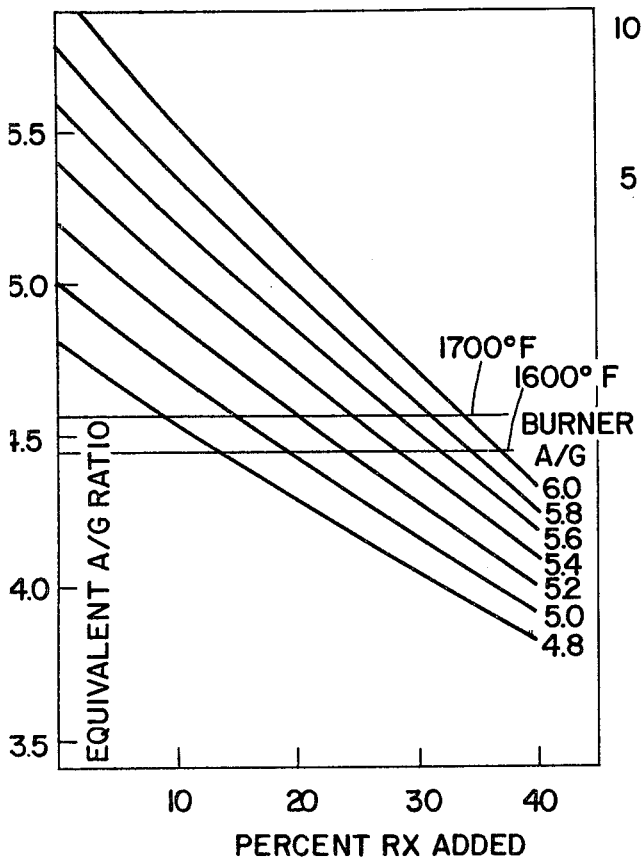
FIG. 8 is a graph of the equivalent air to gas vs. percent RX added for various burner air to gas (A/G) ratios at 1600° F. and 1700° F.

Curves were plotted in FIG. 8 to show the percentage of endothermic gas necessary for various burner air In the experimental work carried out in this program using a 125 TMG burner, flow measurements indicated that the burner was operating at an air to gas ratio of approximately 4.6 to 1 to 5.3 to 1. This differs from the calculated air to gas ratio obtained by chemical analysis of approximately 4.3 to 1 to 4.6 to 1. The air to gas ratio obtained by flow measurements was higher than that obtained by chemical analysis. It can be seen from FIG. 8 that the air to gas ratio differences could mean a large difference in the quantity of endothermic gas required for obtaining proper atmosphere.

The experimental results show that the use of a precombustion chamber to aid in direct heating of the treatment chamber of a furnace resulted in satisfactory performance. In a carburizing process in which gas and air were burned using a throat mix burner and a precombustion chamber with endothermic gas introduced directly into the treatment chamber, methane content was not a problem and no sooting difficulties were encountered. By adding the endothermic gas to the test facility it was possible to obtain the proper atmosphere for first zone carburizing work in terms of water to hydrogen and carbon dioxide to carbon monoxide ratios. Satisfactory carbon steel samples were also obtained.

In all cases where a satisfactory atmosphere was obtained endothermic gas was required. It was necessary to add 30 or 40% endothermic gas to achieve a suitable atmosphere. The quantity of endothermic gas required is due to the limitations on the air to gas ratio that can be maintained at the burner. It can be seen by FIG. 8 that the percentage of endothermic gas required could be reduced significantly if the burner air to gas ratio could be reduced. Based on these results it can be seen that an air to gas ratio calculated based upon chemical analysis results being between 4.4 and 4.6 or about 4.5 to about 5.3 based on flow measurements (See Table II), to heat a treatment zone of a furnace to 1600° to 1700° F. requires 30 to 40% added endothermic gas to result in an atmosphere which will not scale or result in sooting during the carburizing of carbon steel articles. Practically, an air to gas ratio of 5.2 to 1 based on flow measurements is used to assure a stable flame. It is anticipated that these results obtained when using a 125 TMG burner in an experimental set up can be closely extended through a commercial size unit. Further, it can be seen that the concept of the present invention used in attaining the above parameters for a heating zone of a continuous carburizing furnace can be extended to obtain the parameters for use in other zones of the furnace.

FIG. 1 shows the positions of a direct fired burner for a two row pusher carburizer for a protection rate of 820 pounds per hour gross. The burners in the drawing could be TMG 250 burners (250 thousand Btu per hour) rated at 250 standard cubic feet per hour of natural gas each. The precombustion chamber is sized to bring the combustion to completion before the products mix with the endothermic gas. The burners operate on a 800° F. preheated air and at an air to gas ratio of 5.2 to 1 after the furnace is brought up to operating temperature and endothermic gas is admitted. The furnace as shown is used with radiant tube heaters to supplement the direct fired heating. If direct fired heating alone was used more direct fired burners would be necessary.

Because direct fired heating results in higher heating rates of the articles to be treated, the zone in which direct fired heating is used can be smaller. In this sample furnace for a two row pusher carburizer with a production of 820 pounds per hour the heating zone can be shortened by one tray position (22 by 22 inches). However, any energy savings incurred by the higher heating rates is negated by the required endothermic gas flow. The operating cost of this is approximately equal to the present non-recuperator radiant tube heat zone. The savings initially is envisioned in the construction cost of a smaller furnace.

Modifications, changes, and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein but rather should be limited by the advance of which the invention has promoted the art.

What is claimed is:

1. A method of directly heat treating articles in the treatment chamber of a heat treatment furnace comprising the steps of:

continuously mixing outside the treatment chamber, a stream of fuel and a stream of air wherein the amount of air is less than that stoichiometrically required for complete combustion;

igniting the air and fuel mixture;

burning the fuel in the air outside the treatment chamber until the oxygen in the air is completely consumed; and subsequently feeding the reaction products of the burning of the fuel in the air directly into the treatment chamber without further temperature conditioning of such products; and separately feeding a treatment gas directly into the treatment chamber independently of feeding the reaction products into the treatment chamber.

2. The method as recited in claim 1 further comprising the step of preheating the air.

3. A method of carburizing metal articles in the treatment chamber of a heat treatment furnace having at least one burner which is separated from the heat treatment chamber by a combustion chamber which is in communication with the burner and treatment chamber and in close proximity to the treatment chamber, comprising the steps of:

feeding a controlled amount of fuel to the burner;

feeding a controlled amount of air to the burner to form a mixture of fuel and air, the amount of air being less than that stoichiometrically required for complete combustion of the fuel;

igniting the mixture of fuel and air and circulating the ignited mixture to the combustion chamber outside the treatment chamber;

burning the fuel in the air in the combustion chamber until the oxygen in the air is completely consumed;

feeding the reaction products of the burning of the fuel in the air from the combustion chamber directly into the treatment chamber without further temperature conditioning of such products;

separately feeding a treatment gas directly into the treatment chamber independently of feeding the reaction products into the treatment chamber.

4. The method as recited in claim 3 wherein the means to complete combustion is a precombustion chamber.

5. The method as recited in claim 4 further comprising the step of preheating the air.

6. The method as recited in claim 3 wherein the burner means is a throat mix burner.

7. The method as recited in claim 3 further comprising the step of controlling the temperature in the treatment chamber to between 1600° F. and 1800° F.

8. The method as recited in claim 7 wherein:

the air to gas ratio based on chemical analysis is between about 5.0 and the lowest value before the burner means becomes unstable;

the treatment gas consists essentially of about 40% by volume of $N_2$, 40% by volume $H_2$ and 20% by volume CO, and between 30 and 40% by volume of treatment gas is added to the treatment chamber.

9. The method as recited in claim 8 wherein:

the furnace temperature is controlled to between 1600° F. and 1700° F., the air to gas ratio based on chemical analysis is between about 4.6 and the lowest value before burner instability when between 30 and 40% by volume of treatment gas is added to the treatment chamber.

10. The method as recited in claim 3 further comprising the step of mixing the reaction products and the treatment gas within the treatment chamber.

11. An apparatus to heat treat articles, comprising:

a heat treatment chamber in which the articles are placed for heat treatment;

at least one burner in spaced relation from the heat treatment chamber;

means for circulating fuel and air to the burner for mixture and ignition, the amount of air being less than that stoichiometrically required for complete combustion of the fuel;

a combustion chamber disposed between the heat treatment chamber and burner and communicating therewith and designed to receive the ignited mixture of fuel and air from the burner, the combustion chamber being sized such that there occurs therein a complete reaction of the ignited mixture of fuel and air, the combustion chamber being adjacent and in close proximity to the heat treatment chamber such that the reaction products of the burning of the fuel in the ignited mixture of fuel and air in the combustion chamber flows directly into the heat treatment chamber without further temperature conditioning; and means for separately circulating treatment gas to the treatment chamber independently of the reaction products flowing into the treatment chamber.

12. The apparatus as recited in claim 11 wherein the burner is a throat mix burner which comprises a throat in which air and fuel are mixed, and a burner ignition chamber between the throat and the combustion chamber and wherein the air and fuel mixture are ignited.

13. The apparatus as recited in claim 11 further comprising a means to preheat air which is fed to the burner.

14. The apparatus as recited in claim 11 wherein the combustion chamber is cylindrical and has a pair of opposing ends with aligned openings which communicate with the burner and treatment chamber, respectively.

15. The apparatus as recited in claim 11, wherein the treatment gas is a gas used to carburize articles in the treatment chamber.

16. The apparatus as recited in claim 11, which includes at least one radiant heater disposed in the heat treatment chamber.

* * * * *